United States Patent [19]

Fukuta et al.

[11] Patent Number: 4,615,256

[45] Date of Patent: Oct. 7, 1986

[54] METHOD FOR FORMATION OF THREE-DIMENSIONAL WOVEN FABRIC AND APPARATUS THEREFOR

[75] Inventors: Kenji Fukuta, Ibaraki; Eiji Aoki, Hachioji; Yoshihiro Nagatsuka; Takeshi Kitano, both of Ibaraki, Japan

[73] Assignee: Agency of Industrial Science & Technology, Ministry of International Trade & Industry, Tokyo, Japan

[21] Appl. No.: 715,402

[22] Filed: Mar. 25, 1985

[30] Foreign Application Priority Data

Mar. 23, 1984 [JP] Japan ..... 59-56547

[51] Int. Cl.[4] ..... D04C 1/00

[52] U.S. Cl. ..... 87/33; 87/37; 139/11

[58] Field of Search ..... 139/1 R, DIG. 1, 11; 87/33, 37, 24

[56] References Cited

U.S. PATENT DOCUMENTS 3,834,424 9/1974 Fukuta et al. ..... 139/22

4,336,296 6/1982 Fukuta et al. ..... 139/383 R

FOREIGN PATENT DOCUMENTS 53-4143 2/1978 Japan .

*Primary Examiner*—Henry S. Jaudon

*Assistant Examiner*—Joseph S. Machuga

*Attorney, Agent, or Firm*—Oblon, Fisher, Spivak, McClelland & Maier

[57] ABSTRACT

A method for the formation of a three-dimensional woven fabric comprises causing arms of carriers disposed around one component yarns out of three mutually perpendicular component yarns and having the other two component yarns separately held thereon to be rotated, opposing carrier arms of adjacent carriers to each other thereby effecting transfer of yarns, and successively effecting said transfer of yarns to carrier arms of the subsequent carriers thereby enabling the two component yarns to be displaced and zigzagged relative to the remaining one component yarn. An apparatus for effecting the aforementioned method essentially comprises a multiplicity of carriers arrayed longitudinally and laterally on a carrier holding plate and means for imparting necessary movements to the carriers. The three-dimensional woven fabric can be formed in a desired shape or yarn arrangement by suitably varying the pattern of arrangement of the two component yarns.

10 Claims, 20 Drawing Figures

METHOD FOR FORMATION OF THREE-DIMENSIONAL WOVEN FABRIC AND APPARATUS THEREFOR

FIELD OF THE INVENTION

This invention relates to a method for the manufacture of a three-dimensional woven fabric of a desired shape formed of three component yarns laid in longitudinal, lateral, and vertical directions and to an apparatus to be used for working the method.

BACKGROUND OF THE INVENTION

Three-dimensional woven fabrics formed of three component yarns, i.e. longitudinal yarns, lateral yarns, and vertical yarns are used as woven or as the substrate for fiber-reinforced composite materials using matrices of resin or inorganic substance. Particularly, composite materials using the three-dimensional woven fabric have found utility as materials for heat-resistant parts in high-speed flying bodies such as rockets because they exhibit outstanding composite effects embracing shear strength and other mechanical properties and thermal properties as well. These materials are expected to find extensive utility in a wide spectrum of applications demanding various structures which feature light weight and high strength.

Concerning the method and apparatus for the formation of such three-dimensional woven fabric as described above, means of obtaining a perpendicularly intersecting woven fabric having longitudinal yarns and lateral yarns laid straight in parallel between series of vertical yarns (as disclosed in Japanese Pat. No. 922,489), means of obtaining a woven fabric having yarns in one direction displaced and zigzagged relative to a series of longitudinal yarns by alternately causing adjacent rows of longitudinal yarns to be translated to permit insertion of vertical yarns therebetween (as disclosed in Japanese Pat. No. 933,637), and means of laterally displacing and zigzagging the positions of both lateral and vertical yarns relative to rows of longitudinal yarns (as disclosed in Japanese Pat. No. 1,121,410) have been known to the art.

The means enumerated above as known to the art turn out to be methods or apparatuses which are useful for the formation of relevant textiles, namely a three-dimensional woven fabric having component yarns arranged in a perpendicularly intersecting pattern, a woven fabric having yarns in one selected direction displaced and zigzagged, and a woven fabric having yarns in two directions displaced and zigzagged relative to the yarns in the other remaining direction. They, however, are devoid of versatility and consequently incapable of enabling the condition of yarn arrangement to be freely varied or permitting their woven fabrics to be formed in various cross-sectional shapes as desired.

In U.S. Pat. No. 4,312,261, there is proposed an apparatus which is highly versatile in terms of arrangement of fibers and which permits a multiplicity of yarns or strands to be interwoven in various patterns by causing yarn feeders having yarns or strands wound up on bobbins to be suitably moved by electric commands and magnetic force. However, this apparatus is not intended to form a three-dimensional woven fabric by combining yarns of different dimensions as laid in perpendicularly intersecting X, Y, and Z directions. In terms of arrangement of fibers, the invention of this U.S. patent conceptually belongs to the category of the conventional braid formation. The product of this invention, therefore, differs in construction and combination of yarn components from the three-dimensional woven fabric. The invention is incapable of producing a three-dimensional woven fabric which possesses three-dimensional isotropy or anisotropy which is an important attribute to the substrate for component materials.

OBJECT OF THE INVENTION

This invention aims at overcoming the aforementioned drawbacks suffered by the conventional devices. An object of this invention is to provide a method and apparatus which enable a three-dimensional woven fabric consisting of three component yarns, i.e. longitudinal yarns, lateral yarns, and vertical yarns, or a three-dimensional woven fabric consisting of three component yarns, i.e. circumferential yarns, radial yarns, and longitudinal yarns, to be efficiently formed in a construction having two component yarns displaced and zigzagged relative to the remaining one component yarns. Another and more particular object of this invention is to provide a method and apparatus which, in the formation of such a three-dimensional woven fabric as mentioned above, are versatile in the selection of paths for the component yarns to be displaced and zigzagged and further versatile in the selection of patterns of weaving sufficient for permitting manufacture of woven fabrics formed in the shape of cubes, hollow angular columns, and cylinders.

SUMMARY OF THE INVENTION

To accomplish the objects described above, the method of this invention effects formation of a three-dimensional woven fabric by rotating carriers one each around one component yarn of three perpendicularly intersecting component yarns, with the remaining two component yarns held on bobbins supported in the arms of the carriers or adapted to have their ends held directly in the carrier arms, and successively transferring the bobbins or the yarn ends to arms of the subsequent carriers. In consequence of the operation just described, the two component yarns are enabled to be suitably displaced and zigzagged relative to the remaining one component yarns to give rise to the three-dimensional woven fabric aimed at.

The apparatus of this invention for working the aforementioned method in the formation of a three-dimensional woven fabric comprises a multiplicity of carriers disposed on a carrier fixing plate. These carriers are each formed of a carrier shaft provided in the interior thereof with an insertion hole and a carrier arm disposed on the carrier shaft, adapted to be rotationally driven to effect transfer of a bobbin or a yarn end to the subsequent carrier, and possessing at least one arm piece. With the apparatus constructed as described above, desired formation of a three-dimensional woven fabric is attained by passing one component yarn through the insertion holes in the carrier shafts, allowing the carrier arms holding therein the other two component yarns or the bobbins having the two component yarns wound thereon to be rotated around the one component yarns, and successively transferring the ends of the two component yarns or the bobbins to the subsequent carrier arms thereby enabling the two perpendicularly intersecting component yarns to be displaced and zigzagged relative to the one component yarn advancing through the insertion holes.

BRIEF DESCRIPTION OF THE DRAWINGS

The characteristic features of the present invention will become more apparent from the description given in further detail hereinbelow with reference to the accompanying drawings, in which.

DESCRIPTION OF THE PREFERRED EMBODIMENTS

Figure 1:
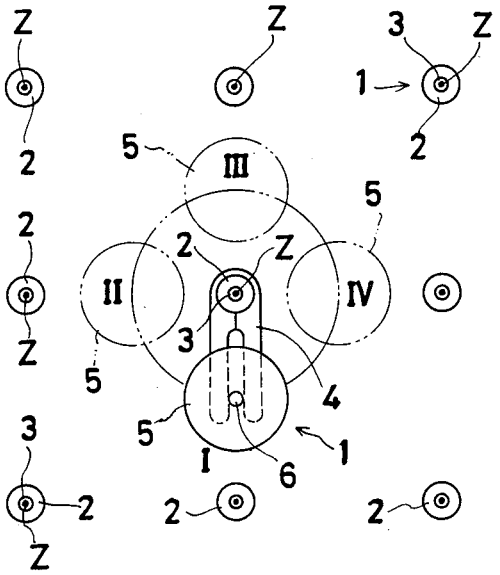
FIG. 1 is an explanatory plan view schematically illustrating the operation principle of carriers which are an essential component for the construction of one embodiment of the present invention.

FIG. 1 illustrates the basic construction of a carrier which constitutes an essential element for the construction of a typical apparatus for the formation of a three-dimensional woven fabric as a first embodiment of this invention and the manner of movements produced by the carrier. In this embodiment, the yarns to be displaced and zigzagged between the parallel rows of yarns are supplied by being released from bobbins. The carriers 1, therefore, are bobbin carriers whose function is to effect successive transfer of bobbins to the subsequent carriers. The carriers 1 are each formed of a carrier shaft 2 provided therein with an insertion hole 3 for a vertical yarn (hereinafter referred to as "Z yarn") and a carrier arm 4 enabled to take hold of and release a shaft 6 for a bobbin 5 holding thereon a longitudinal yarn and a lateral yarn to be arranged in a plane perpendicularly intersecting the Z yarn (hereinafter referred to respectively as "X yarn" and "Y yarn"). The carrier arms 4 can rotate around their respective carrier shafts 2 and are so constructed as to effect successive transfer of the bobbins 5 to the subsequent carriers at the four circumferentially spaced positions I, II, III, and IV. In FIG. 1, only one carrier is illustrated in detail and merely carrier shafts 2 of the other carriers are depicted.

The carriers 1 are rotated by an electric device such as a pulse motor or a mechanical device such as a toothed wheel attached directly to the respective carrier shafts 2, so that the movement of each carrier 1 is synchronized with the movement of the other carriers 1 in accordance with the construction of the woven fabric aimed at.

The majority of these carriers 1 are disposed on a plane perpendicularly intersecting the Z yarns, depending on the size and shape of the three-dimensional woven fabric. The distance equally separating the carrier shafts 2 (hereinafter referred to as "carrier pitch") is twice the distance between the axes of the carrier shafts 2 and the axes of the bobbin shafts at the positions the bobbins are held in place.

Figure 2:
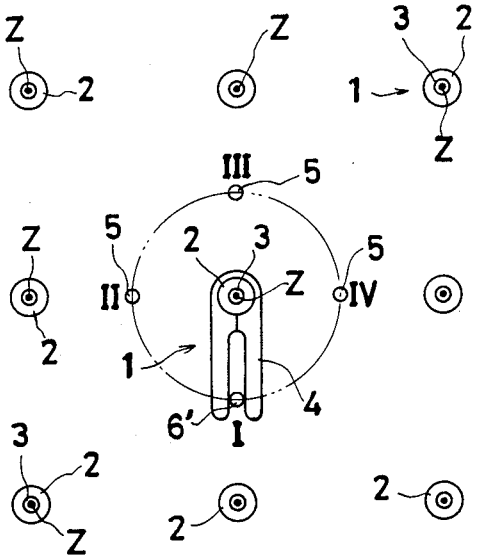
FIG. 2 is an explanatory plan view schematically illustrating the operating principle of carriers in another embodiment of this invention.

In a second embodiment of this invention illustrated in FIG. 2, yarn carriers are used as the carriers 1. The bobbin carriers used in the first embodiment and the yarn carriers in the second embodiment are equivalent. The bobbin shafts 6 are held in place by the carrier arms 4 in the first embodiment, whereas the carriers used in the second embodiment are modified so as to take direct hold of yarn ends 6'. These two embodiments are identical in all the other respects, namely in terms of the other component elements and their movements.

Figure 3:
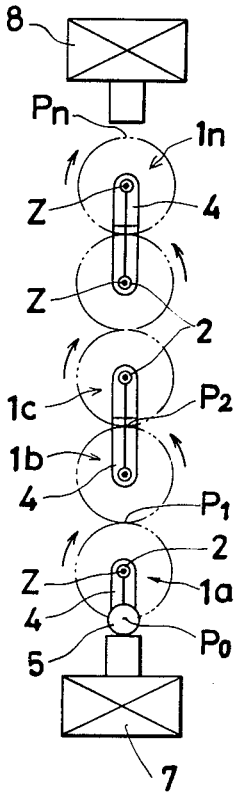
FIG. 3 is a schematic explanatory diagram illustrating displacing and zigzagging movements of yarns brought about by the carriers of FIG. 1.

Now, the basic operation of the carriers for the guidance of yarns in the first and second embodiments will be described below with reference to FIG. 3. In FIG. 3, the operation is depicted as effected with the bobbins used in the first embodiment of FIG. 1. By interpreting the term "bobbin shafts" used herein as additionally representing yarn ends because of their equivalency described above, the operation of causing yarns to be directly held in place by carriers involved in the second embodiment of FIG. 2 will be readily understood.

In FIG. 3, for the sake of simplicity of illustration, the carriers 1*a*–1*n* regularly spaced by the carrier pitch are portrayed as disposed in one signle row so that the adjacent carriers will be rotated in mutually opposite directions. Each row of carriers is provided at the opposite ends thereof with package stations 7, 8. In the embodiment of FIG. 1 using bobbins, bobbins 5 having a required length of yarn wound thereon are temporarily stored on the package stations 7, 8. In this connection, in the embodiment of FIG. 2, X yarns or Y yarns of a kind and a length proper for the construction of the woven fabric aimed at are stored on the package stations 7, 8.

In the construction described above, one bobbin 5 supplied from the package station 7 is caught in the carrier arm 4 of the carrier 1*a* at the bobbin transfer position $P_0$. This carrier arm 4 makes one half clockwise rotation around the carrier shaft 2 and reaches the bobbin transfer position $P_1$, there to have the bobbin 5 deposited in the carrier arm 4 of the carrier 1*b* which is rotated as synchronized with the carrier 1*a*. At the same time, the carrier 1*a* releases its hold on the bobbin 5. The bobbin 5 now held in place in the carrier arm 4 of the carrier 1*b* is delivered to the subsequent carrier 1*c* after the carrier 1*b* has completed its one half counterclockwise rotation. After this procedure has been repeated on all the carriers involved, the bobbin 5 is finally moved to the package station 8.

Prior to the operation described above, a required number of Z yarns are passed through the Z yarn insertion holes 3 in all the carriers. With the Z yarns so positioned in the carriers, these carriers are caused to hold one bobbin 5 after another supplied from the package station 7 and the carriers are rotated as described above to pass the bobbins 5 through the series of carriers from the package station 7 to the other package station 8, with the result that the Y yarns ($Y_1$) are laid in the path as illustrated in FIG. 4(A).

Then by returning the bobbins 5 to the package station 7 by reversing the aforementioned procedure, the Y yarns ($Y_2$) are laid as illustrated in FIG. 4(A). Thus, these Y yarns can be arranged as displaced and zigzagged relative to the Z yarns.

As concerns the movement of bobbins illustrated in FIG. 3, when the amount of a yarn wound in advance on each of the bobbins 5 at the package station 7 is sufficient for the bobbin to be passed on through the series of carriers and brought to the package station 8 without requiring the yarn to be replenished in transit and when the bobbin 5 so brought to the package station 8 is not required to be retained there because of the particular yarn construction, the bobbin 5 can be returned from the bobbin transfer position $P_n$ directly to the package station 7 without being sent through the package station 8.

The majority of the carriers 1 are used as disposed on a plane perpendicularly intersecting the Z yarns. Similarly to the Y yarns described above, the X yarns are enabled by these carriers to be arranged as displaced and zigzagged relative to the Z yarns. FIG. 4(A) illustrates the condition in which the Y yarns and X yarns are displaced and zigzagged relative to the Z yarns. The package stations 7*x*, 7*y*, 8*x*, and 8*y* illustrated in this diagram are disposed as aligned to the files and the rows of Z yarns. OptionallY, just one or a plurality of package stations may be disposed for the X yarns and the Y yarns and may be traversed to the files and rows as required.

The aforementioned arrangement of yarns represents a case wherein the carriers spaced in the direction of X yarns or Y yarns are rotated alternately in opposite directions to effect transfer of bobbins. By suitably selecting the direction of rotation of the individual carriers and effecting transfer of bobbins from one carrier to another in a particular pattern accordingly determined, there can be obtained a three-dimensional woven fabric in which the paths for the yarns displaced and zigzagged are varied. FIG. 4(B) illustrates a typical arrangement of yarns resulting from the aforementioned suitable selection of the directions of rotation. In the carriers corresponding to the row of Z yarns, $Z_{1-1}$, $Z_{1-2}$, . . . $Z_{1-n}$, arranged in the first row in the longitudinal direction, the carriers corresponding to the Z yarns, $Z_{1-1}$, $Z_{1-5}$, . . . $Z_{1-7}$, are rotated in the clockwise direction and the remaining carriers are rotated in the counterclockwise direction to lay $Y_1$ yarn from the package station 7*y* to the package station 8*y* and $Y_2$ yarn from the package station 8*y* to the package station 7*y*. Then, with respect to the row of Z yarns, $Z_{2-1}$, $Z_{2-2}$, . . . $Z_{2-n}$, arranged in the second row in the longitudinal direction, the positions through which $Y_1$ and $Y_2$ yarns are displaced and zigzagged are staggered from those in the first row. Similarly, in the carriers corresponding to the row of Z yarns, the carriers corresponding to the Z yarns, $Z_{2-1}$, $Z_{2-2}$, $Z_{2-6} \sim Z_{2-8}$ are rotated in the clockwise direction, and the remaining carriers are rotated in the counterclockwise direction to lay $Y_1$ yarn from the package station 7*y* to the package station 8*y* and $Y_2$ yarn from the package station 8*y* to the package station 7*y*. The procedure is repeated on the third and following rows and on the Y yarns to lay the yarns in the direction of Y and the direction of X. In this case, the three-dimensional woven fabric is formed so that the X yarns and the Y yarns contain relatively straight portions in a large proportion and the positions in the woven fabric at which the X yarns and the Y yarns are displaced and zigzags relative to the Z yarns are not concentrated in specific files and rows of yarns.

The formation of three-dimensional woven fabric in the manner described above assures versatility of operation, not merely in the selection of paths for the movements of yarns displaced and zigzagged, but also in the selection of patterns of weaving to permit manufacture of woven fabrics in the shape of cubes, hollow angular columns, and cylinders.

Figure 4:
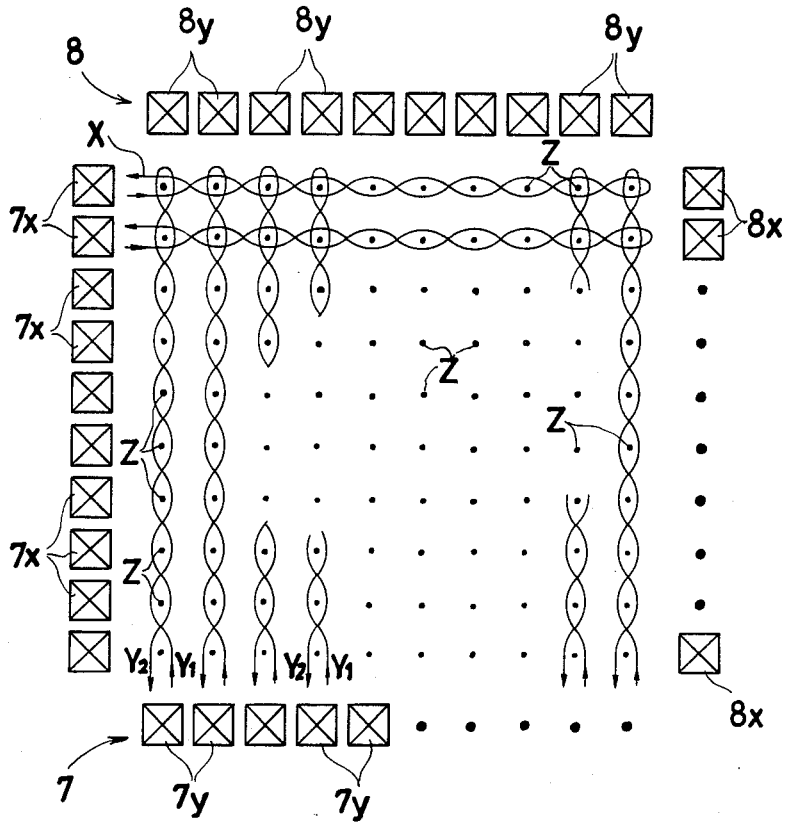
FIGS. 4(A) and 4(B) and FIGS. 5 and 6 are explanatory diagrams illustrating other conditions of yarn arrangement resulting from displacing and zigzagging movements of yarns in varying patterns.
Figure 4:
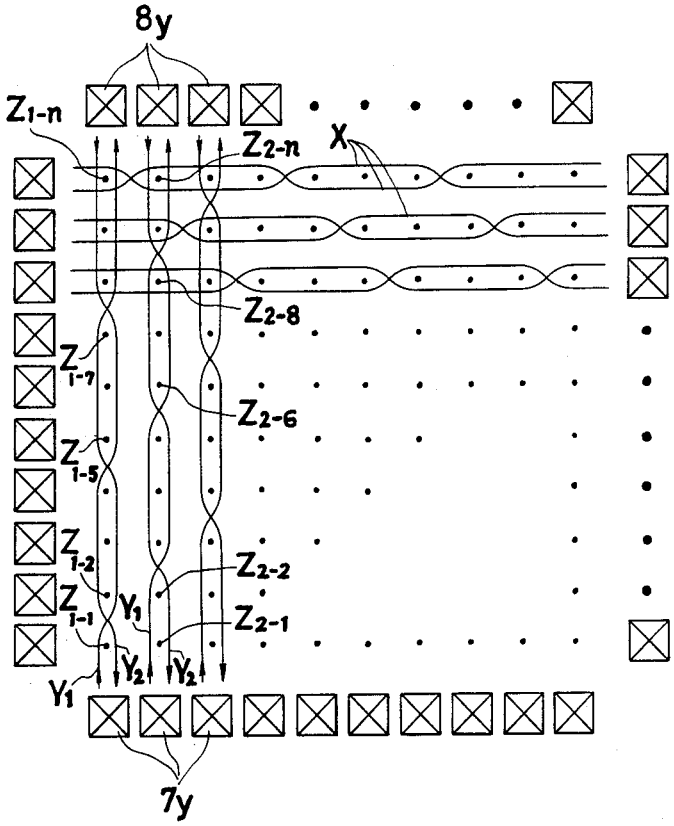
Figure 5:
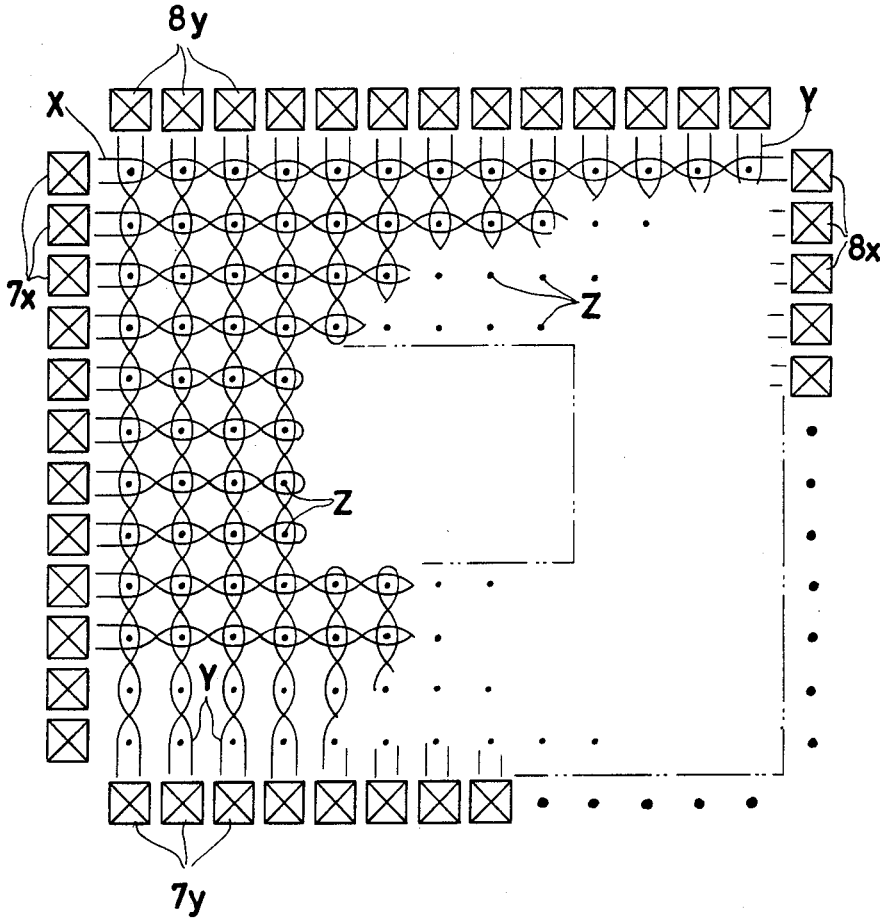
Figure 6:
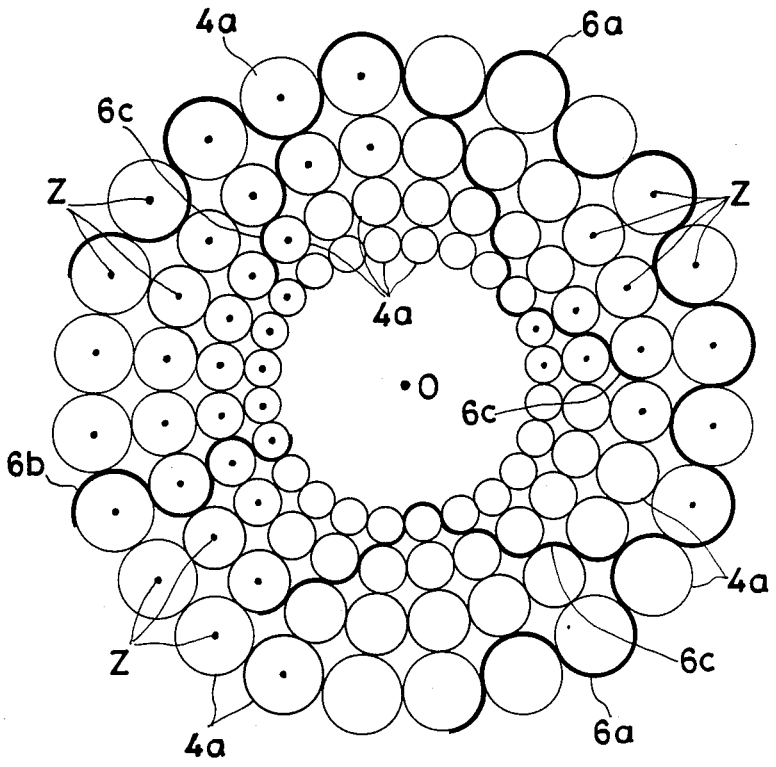

FIGS. 4 through 6 are for illustrating this versatility. FIGS. 4(A), (B) represent a case wherein the cross section perpendiculary intersecting the Z yarns has a rectangular shape, FIG. 5 a case wherein the woven fabric has the shape of a hollow rectangle, and FIG. 6 a case wherein the woven fabric has the shape of a cylinder.

Particularly by disposing the Z yarns only at selected positions and causing the X yarns and the Y yarns to be displaced and zigzagged relative to the Z yarns as illustrated in FIG. 5, the shape of the cross section of the woven fabric perpendicularly intersecting the Z yarns can be freely selected. In this case, since the apparatus is operated by the method causing the bobbins accommodating the X yarns and the Y yarns are successively transferred along the row of carriers, the X yarns and the Y yarns can be effectively displaced and zigzagged relative to the Z yarns which are disposed only at the selected positions.

In FIG. 6, fine lines represent loci 4*a* of the bobbin holding position of the carrier arms around the Z yarns, and heavy lines represent loci 6*a*, 6*b*, and 6*c* of the bobbin shafts displaced and zigzagged between the Z yarns. The aforementioned loci correspond to the paths of the X yarns and the Y yarns arranged as displaced and zigzagged between the Z yarns. The locus 6*a* represents the path of a yarn laid in the circumferential direction, the locus 6*b* the path of a yarn laid in the radial direction, and the locus 6*c* the path of a yarn laid obliquely in the generally radial direction. The two component yarns, X yarn and Y yarn, to be displaced and zigzagged relative to the Z yarn may be formed of the yarns laid in the circumferential direction and the radial direction as indicated by the loci 6*a*, 6*b*. Otherwise, they may be formed of the yarn laid in the direction indicated by the locus 6*c* or of the combination of this yarn with a yarn laid in some other direction. In this case, the pitch of movement of the bobbins moved in the circumferential direction as displaced and zigzagged relative to the Z yarns corresponds to the carrier pitch separating the adjacent carrier shafts arranged on one and the same circle. The pitch of movement of the bobbins moved in the radial direction as displaced and zigzagged relative to the Z yarns corresponds to the carrier pitch separating the adjacent carrier shafts in the radial direction.

Now, the specific construction and operation of a carrier used for displacing bobbins will be described in detail below with reference to FIG. 7 through FIG. 11.

Figure 8:
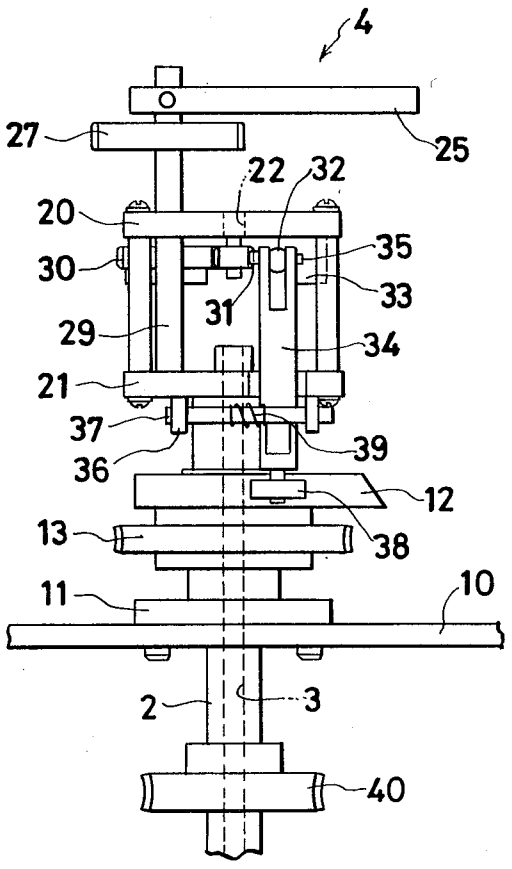
FIGS. 7 and 8 are a partially cutaway front view and a side view, respectively, of a typical carrier.
Figure 7:
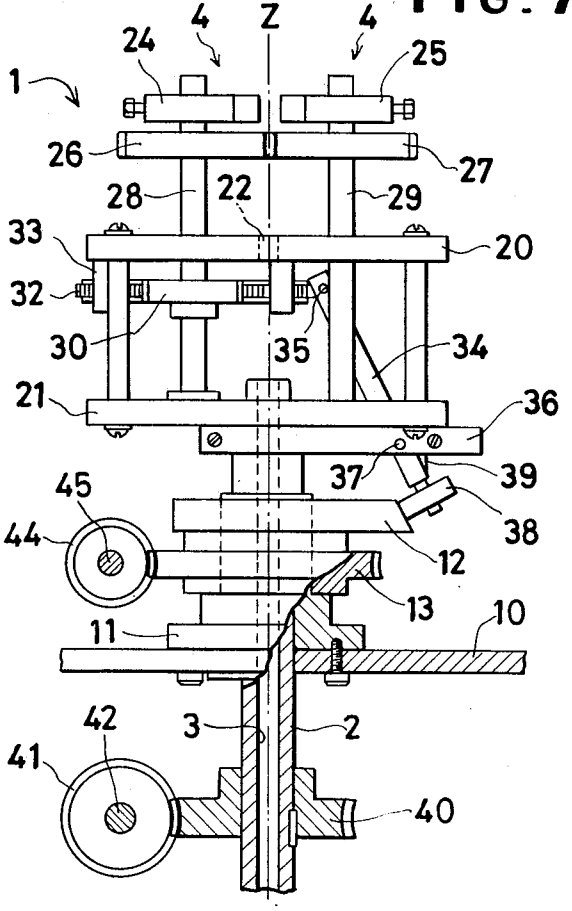

A multiplicity of carriers 1 constructed as illustrated in the front view of FIG. 7 and the side view of FIG. 8 are arranged as regularly spaced longitudinally and laterally on the carrier fixing plate 10 laid perpendicularly to the Z yarns. On the fixing plate 10, the carrier shaft 2 pierced through the fixing plate is rotatably supported by a carrier shaft supporting block 11. On the carrier shaft supporting block 11, a cam 12 for controlling the holding movement of the carrier arm 4 and a toothed wheel 13 for revolving the working position of the cam 12 are integrally disposed and rotatably fitted into the carrier shaft supporting block 11.

The carrier shaft 2 which is rotatably supported by the carrier shaft supporting block 11 is provided at the center thereof with the insertion hole 3 for the Z yarns as described previously. To the upper end of the carrier shaft 2 are fixed a pair of upper and lower support plates 20, 21 serving to support the carrier arm 4 and other parts pivotally. To lead out the Z yarns passed through the insertion hole 3, the support plate 20 has a yarn outlet hole 22 bored therein.

Figure 10:
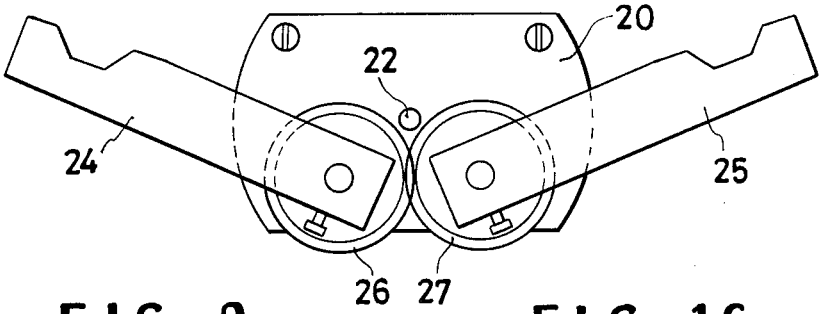
FIGS. 9 and 10 are plan views illustrating the conditions of movements of the carrier of FIGS. 7 and 8.
Figure 9:
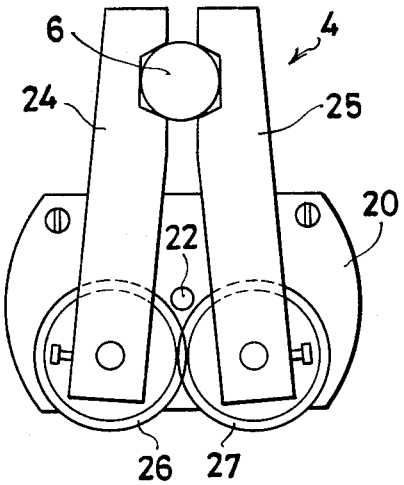

The carrier arm 4 provided on the support plate 20 is formed, as illustrated in FIG. 9 and FIG. 10, of one pair of arm pieces 24, 25 adapted to pinch the shaft 6 of the bobbin 5 on the opposite sides thereof. The pair of arm pieces 24, 25 and mutually engaging synchronized toothed wheels 26, 27 are attached to carrier arm shafts 28, 29. These carrier arm shafts 28, 29 are rotatably supported by the support plates 20, 21. On one of the carrier arm shafts 28, 29 is fixed a carrier arm rotating toothed wheel 30. This carrier arm rotating toothed wheel 30 is engaged through an intermediate toothed wheel 31 with a rack 32 adapted to slide along a supporting block 33 fixed on the support plate 20.

The rack 32 is adapted so as to be reciprocated in the tangential direction of the intermediate toothed wheel 31 by the rotation of a lever 34 rotatably connected to one end of the rack 32 with a connecting pin 35. The lever 34 is rotatably supported with a supporting pin 37 on a lever supporting block 36 integrally fixed in the middle portion thereof on the support plate 21. The lever 34 is also provided on the other end thereof with a sliding member 38 adapted to come into contact with the cam 12. The sliding member 38 is constantly kept in forced contact with the cam 12 by a spring 39. When the lever 34 is tilted by the working recess **12*a* of the cam 12 illustrated in FIG. 11, therefore, the rack 32 is caused to slide thereon and the carrier arm shaft 28 is rotated, with the result that the arm pieces 24, 25 of the carrier arm take hold of the bobbin shaft 6 in the manner illustrated in FIG. 9 and the two arm pieces 24, 25 are released by the recess 12*b* of the cam as illustrated in FIG. 10**.

The majority of the carriers 1 constructed as described above are regularly arrayed on the carrier fixing plate 10. In this case, there is provided means capable of synchronously driving these carriers so as to effect successive transfer of bobbins through the rows of carriers. To be specific, a toothed wheel 40 fixed on the aforementioned carrier shaft 2 is meshed with a worm gear 41 adapted to drive the toothed wheel 40. Thus, the toothed wheel 40 is rotated by a shaft 42 of the worm gear 41. In consequence of the rotation of the carrier shaft 2 by this shaft 42, the carrier arm 4 can be rotated to a rotational position suitable for transfer of a bobbin. On the shaft 42 of the worm gear 41, a plurality of worm gears adapted to be meshed with the toothed wheels on the carrier shafts of the carriers arrayed longitudinally and laterally on the carrier fixing plate 10 may be disposed, when necessary, through clutches, for example. Of course, the toothed wheels 40 intended for the rotation of the carrier shafts of the carriers can be driven and controlled by independent drive sources. The toothed wheel 13 for revolving the operating position of the cam 12 is meshed with a worm gear 44 on a cam drive shaft 45. Similarly to the shaft 42 for rotating the carrier shaft 2, this cam drive shaft 45 is driven to be synchronized with the rotation of the cam in the carrier, depending on the arrangement of yarns aimed at.

When the carrier arms of two adjacent carriers are moved to the position of bobbin transfer, they are not allowed to collide against each other. To avoid this collision, it is necessary that the carrier arms of the two adjacent carriers should be vertically staggered from each other.

In the carrier constructed as described above, when the cam 12 is rotated to a prescribed position by the worm gear 44 and then retained stably in that position and the carrier shaft 2 is rotated to a prescribed direction by the rotation of the toothed wheel 40 by the use of the worm gear 41, the support plates 20, 21 integrated with the carrier shaft 2, the carrier arm 4 mounted thereon, the rack driving lever 34, etc. are rotated around the axis of the carrier shaft 2. While their rotation is in progress, the sliding member 38 is brought into forced contact with the cam 12 and revolved around the cam 12. When the sliding member 38 rides on the operating protuberance **12*a* of the cam 12, the lever 34 for driving the rack is caused to rotate about the support pin 37 as the fulcrum. Consequently, the rack 32 is caused to reciprocate along the supporting block 33. This reciprocation of the carrier arm driving rack 32 is transmitted through the intermediate toothed wheel 31 and the carrier arm rotating toothed wheel 30 and converted into a rotational movement of the carrier arm shaft 28. Further, the carrier arm shaft 29 is rotated synchronously by the synchronized toothed wheels 26, 27. Consequently, the arm pieces 24, 25 of the carrier arm 4 take firm hold of the shaft 6 of the bobbin 5**.

Figure 11:
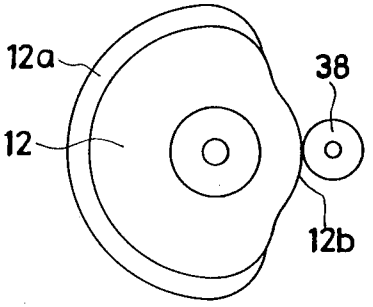
FIG. 11 is a plan view illustrating a cam incorporated in the carrier.

The position at which the arm pieces 24, 25 of the carrier arm 4 are to be opened and closed for the purpose of taking hold of and releasing the shaft 6 of the bobbin 5 (the positions I, II, III, and IV illustrated in FIG. 1) can be selected by rotating the toothed wheel 13 with the cam driving shaft 45 and setting the protuberance **12*a* and the recess 12*b* of the cam at the prescribed positions illustrated in FIG. 11**, depending on the arrangement of yarns in the three-dimensional woven fabric and the shape of the woven fabric.

Now, the aforementioned package station will be generally described in below. Having substantially the same construction as the aforementioned package carrier, the package station is additionally provided with means for winding a yarn on the bobbin held thereon or means for exchanging a full bobbin for an empty one. Optionally, it may be provided with means of producing traverse movement along the carrier fixing plate. Thus, it is enabled to retain temporarily the bobbin for the Y yarn and, when necessary, feed the yarn to the bobbin.

Since the package station is capable of feeding the yarn from time to time to the bobbin, use of the package station permits a size reduction in the bobbin to be handled and enables continuous formation of three-dimensional woven fabric without requiring use of bobbins of a large size. Further, as the bobbins to be handled can be lighter in weight, the transfer of a bobbin by the package carrier can be effected with added ease and the package carrier itself can be reduced in size.

The foregoing embodiment has been described as constructed so that the opening and closing movements of the arm pieces 24, 25 of the carrier arm 4 will be carried out mechanically by the use of a train of gears 44, 13, 32, and 30, the cam 12, and the lever 34. Alternatively, these movements of the arm pieces 24, 25 may be obtained by electromagnetic means or hydraulic means.

Figure 12:
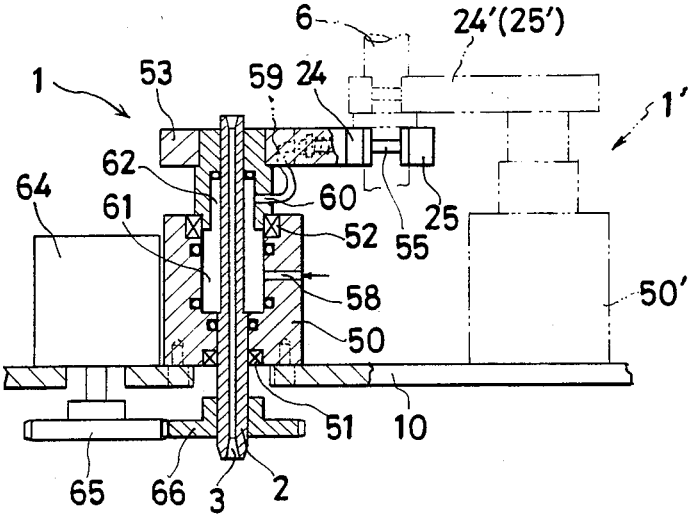
FIGS. 12 and 13 are a side view and a plan view illustrating another embodiment of an arm-piece opening and closing mechanism.
Figure 13:
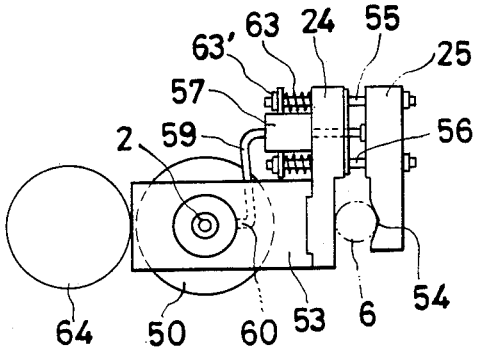

FIGS. 12 and 13 depict another embodiment of this invention which produces the opening and closing movements of the arm pieces 24, 25 by the use of a hydraulic cylinder. Now, this embodiment will be described in detail below with reference to FIGS. 12 and 13.

On the carrier fixing plate 10, the carrier shaft 2 provided with the insertion hole 3 for the Z yarns is rotatably supported by a carrier shaft supporting block 50 and bearings 51, 52. To the upper end of the carrier shaft 2, a carrier arm piece fitting block 52 for supporting the arm pieces 24, 25 of the carrier arm is fitted as integrated with the carrier shaft 2. The shaft 6 of the bobbin holding the X yarn or Y yarn thereon is nipped on the opposite sides thereof by the arm pieces 24, 25 of the carrier arm. The arm piece 25 is provided with a depressed bobbin holder 54 intended to enable the bobbin shaft 6 to be nipped exactly at the prescribed position of the arm piece.

On the arm piece 25 of the carrier arm are fixed two rods 55, 56 which are pivotally supported so as to slide on the other arm piece 24 and ensure safe hold and release of the bobbin shaft 6 by the bobbin holder 54. The arm pieces are interlocked through the medium of the rods to the moving part of a hydraulic cylinder 57 fixed to the arm piece 24.

A hydraulic pressure inlet hole 58 provided on the carrier shaft supporting block 50 is connected to a required pressure generating device (not shown). The free end of a hydraulic pressure inlet pipe 59 connected to the hydraulic pressure input side of the hydraulic cylinder 57 is connected to a pipe connecting hole 60 of the carrier arm piece fitting block 53. A series of conduits are formed of a cavity 61 enclosed with the hydraulic pressure inlet hole 58, the carrier shaft 2, and the carrier shaft supporting block to which the inlet hole 58 is connected, a cavity 62 enclosed with the carrier arm piece fitting block 53 and the carrier shaft 2, the pipe connecting hole 60, and the hydraulic pressure inlet pipe 59. By operating the hydraulic cylinder 57 with the hydraulic pressure delivered from the pressure generator, the arm piece 24' (25') on a supporting block 50' of the subsequent carrier 1' is opened and closed to effect desired hold and release of a bobbin. A spring 63 disposed coaxially with the rod 55 is intended to regulate the pressure of the arm piece 25 opposed to the arm piece 24. By manipulation of a pressure adjusting screw 63', the spring 63 is allowed to regulate the pressure to a level optimum for the holding of the bobbin shaft.

A carrier rotation index 64 attached to the carrier fixing plate 10 is capable of imparting rotations of prescribed angles around the carrier shaft 2 to the arm pieces of the carrier arm through the medium of gears 65, 66. By conferring ON and OFF movements synchronized with the operation of the index 64 upon the hydraulic circuit connected to the hydraulic pressure inlet hole 58 at the prescribed position of the carrier arm piece (position for bobbin transfer), the bobbin holder 54 is opened and closed to effect desired hold and release of a bobbin.

Figure 15:
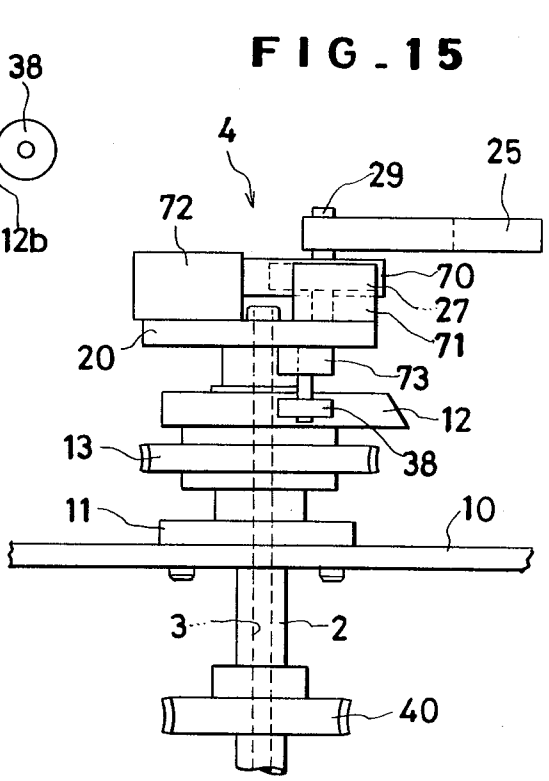
FIGS. 14 and 15 are a partially cutaway front view and a side view illustrating a modified version of the carrier.
Figure 14:
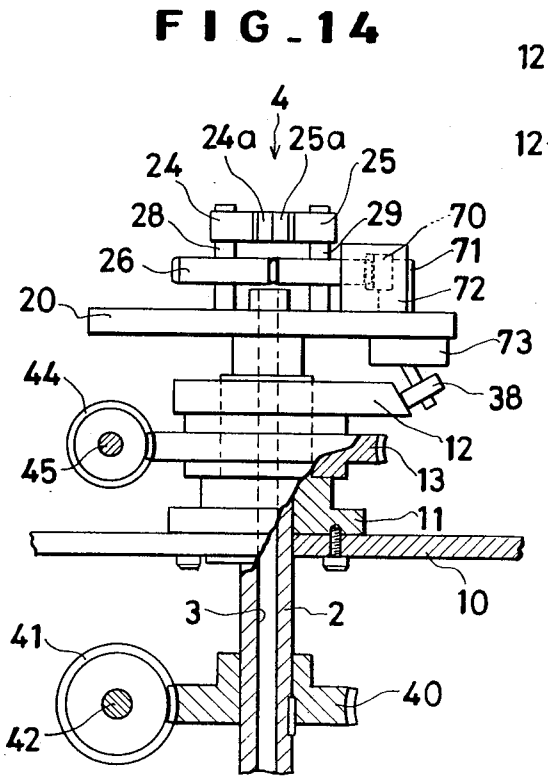

FIGS. 14 and 15 are a front view and a side view illustrating a modified version of the carrier described above. The components denoted by the same symbols as in the foregoing embodiment are equivalent in construction and operation. Only the parts particularly different from the counterparts in the foregoing embodiment will be described below in detail. The carrier illustrated herein has a construction such that it takes direct hold of a yarn end instead of a bobbin and threads its way between the Z yarns in a displacing and zigzagging pattern. This carrier is different from the carrier in the foregoing embodiment only in respect that the distance separating the arm pieces 24, 25 of the carrier arm 4 is smaller in this embodiment than in the foregoing embodiment. It, therefore, can be applied as is to the embodiments of FIG. 1 and FIG. 2 which involve use of bobbins.

In the embodiment shown in FIGS. 14 and 15, a drive system similar to the drive system of the embodiment shown in FIGS. 12 and 13 is formed by causing the carrier shaft 2 which is rotationally driven by the worm gear 41 and the toothed wheel 40 and is provided with the insertion hole 3 to be rotatably supported by the supporting block 11 on the carrier fixing plate 10 and incorporating the cam 12 which is rotationally driven coaxially with the carrier shaft 2 by the worm gear 44 and the toothed wheel 13.

To the upper end of the carrier shaft 2 is fixed the support plate 20 serving to support in place the shaft of the carrier arm 4, for example. To lead out the Z yarns passed through the insertion hole 3, the support plate 20 has a yarn guide hole 22 bored therein.

The carrier arm 4 provided on the support plate 20 is formed of a pair of arm pieces 24, 25 having elastic pads **24*a*, 25*a* such as of rubber attached to the leading ends thereof for the purpose of nipping a yarn end 5. The pair of arm pieces 24, 25 and the mutually engaging synchronized toothed wheels 26, 27 are attached to the carrier arm shafts 28, 29. These carrier arm shafts 28, 29 are rotatably supported by the support plate 20. With the synchronized toothed wheel 27 provided on one of the carrier arm shafts 28, 29 is meshed a rack 70 adapted to slide along the supporting block 71 fixed on the support plate 20**.

Figure 16:
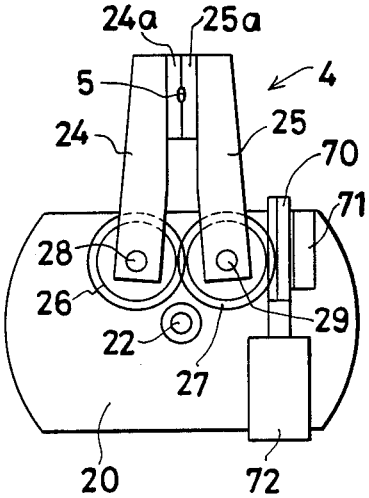
FIGS. 16 and 17 are plan views illustrating the conditions of movements of the carrier of FIGS. 12 and 13.
Figure 17:
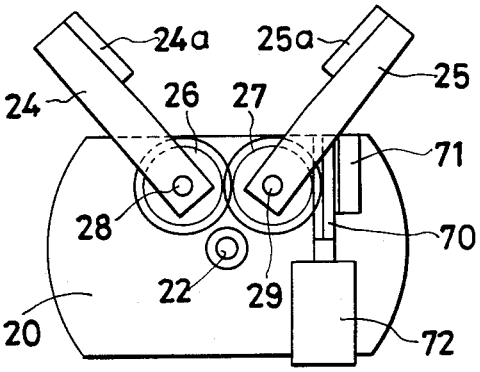

The rack 70 is enabled to reciprocate in the tangential direction of the synchronized toothed wheel 27 by an electromagnet 72 connected to one end of the rack 70. The electromagnet 72 is connected to a power source not shown in the diagram through a microswitch 73 which, by virtue of the contact of the sliding member 38 with the aforementioned cam 12, opens and closes the contact. When the sliding member 38 is tilted by the operating recess **12*a* of the cam 12 illustrated in FIG. 11, therefore, the electromagnet 72 is actuated to set the rack 46 sliding and the carrier arm shaft 28 rotating and the arm pieces 24, 25 of the carrier arm are actuated to take hold of the yarn end 6' in a manner illustrated in FIG. 16. In the recess 12*b* of the cam 12, the electromagnet 72 is allowed to generate a return movement to open the two arm pieces 24, 25 as illustrated in FIG. 17**.

In the carrier constructed as described above, when the worm gear 44 rotates the cam 12 to the prescribed position and retains it in a fixed state and the carrier shaft 2 is rotated in the prescribed direction by the rotation of the toothed wheel 40 generated by the worm gear 41, the support plate 20 integrated with the carrier shaft 2 and the carrier arm 4 mounted on the support plate 20 are rotated around the axis of the carrier shaft 2. While this rotation is in progress, the sliding member 38 is brought into forced contact with the cam 12 and rotated around the cam 12. As the sliding member 38 rides on the operating recess **12*a* of the cam 12, the electromagnet 72 for the rack driving is actuated to impart to the rack 70 a reciprocating movement along the supporting block 71. This reciprocation of the rack 70 for driving the carrier arm 4 is transformed into a rotational movement of the synchronized toothed wheel 27. Since the carrier arm shafts 28, 29 are adapted to be synchronously rotated, the arm pieces 24, 25 of the carrier arm 4 are enabled to take hold of the yarn end 6' as illustrated in FIG. 16**.

Now, the movement of the yarn by the use of the bobbin and the movement of the yarn without use of any bobbin are compared in below terms of operational efficiency. When the bobbin having two component yarns wound thereon is displaced and zigzagged with the carrier relative to the other component yarns as in the embodiments of FIG. 1 and FIG. 2, since the bobbin is sequentially zigzagged around the one component yarns while it continues to release the yarn wound thereon, relative slippage is rarely generated between the yarns involved. In this sense, the use of the bobbin proves highly advantageous where no slippage is desired to be generated between the yarns. The bobbin to be displaced and zigzagged between the yarns, however, is required to hold thereon yarn of a length sufficient for the bobbin to reach the subsequent package station without requiring any replenishment of the yarn. Particularly when the woven fabric being formed has a large width, the length of the yarn to be wound on the bobbin is large. As a result, the bobbin itself is required to possess a large size, the movement of the bobbin suffers loss of stability due to the increase of size, and a force required for driving the bobbin is inevitably increased proportionately. For the bobbin of a large size to be moved between the rows of yarns, the distance separating the rows of yarns or the carrier pitch is required to be increased. Since the increase in the carrier pitch results in a reduction in the density of yarn arrangement, formation of a woven fabric having dense arrangement of yarns becomes difficult. Moreover, the aforementioned increase in the carrier pitch brings about an addition to the apparatus as a whole without any improvement in weaving capacity and, as a natural consequence, entails an increase in the production cost.

The decision for or against the adoption of bobbins, therefore, must be made in due consideration of the state of affairs described above to ensure the optimum outcome of the apparatus contemplated by this invention.

Figure 18:
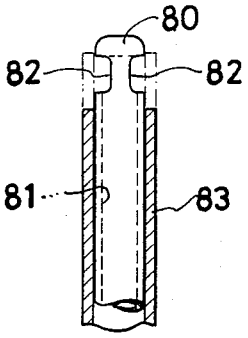
FIG. 18 is a partial explanatory diagram illustrating typical means for positioning and holding a yarn end in the carrier arm.

FIG. 18 illustrates a typical modified version of the carrier arm provided with means capable of positioning and holding a yarn end. This carrier arm may be used in the place of the carrier arm 4 of FIG. 7 or that of FIG. 17. In the case of the construction of FIG. 18, the carrier arm is formed of a single arm piece 80, which is provided in the interior thereof with a suction path 81 for drawing in air by means of an air suction source (not shown). This suction path 81 opens into a yarn holding recess 82 near the leading end of the arm piece 80. On the periphery of this arm piece 80, a tubular sheath 83 is slidably fitted. When the suction of the yarn end by the yarn holding recess 82 is detected by a variation in the pressure within the suction path 81 or when the yarn end is judged to have been sucked by the yarn holding recess 82, the tubular sheath 83 is slid toward the leading end of the arm piece 80 (the position indicated by a chain line) by means of an electromagnet or a hydraulic cylinder, with the result that the yarn is firmly caught in place mechanically.

When the carrier arm is so constructed, since the yarn end is caught at a fixed position, the transfer of the yarn end between the adjacent carrier arms can be carried out with high accuracy.

Mechanisms for suction holding a yarn end find extensive utility in numerous textile machines. Of course, any of such mechanisms may be utilized for the holding of a yarn end in the carrier arm.

Figure 19:
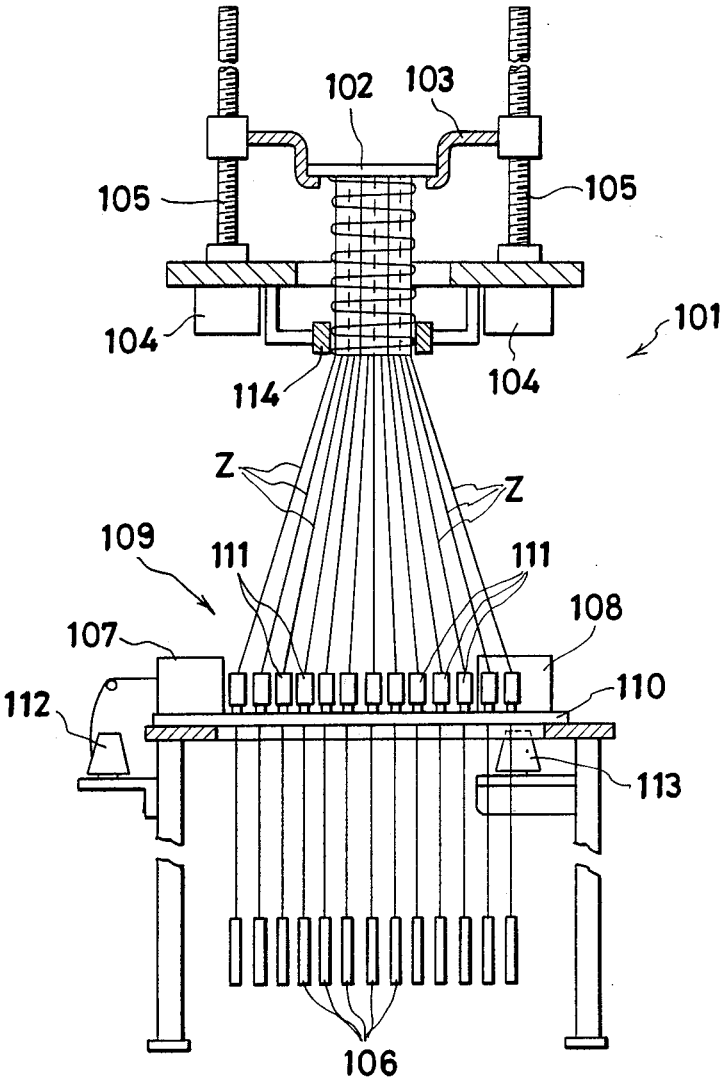
FIG. 19 is a schematic structural diagram of a weaving machine having this invention applied thereto.

FIG. 19 schematically illustrates a weaving machine provided with the aforementioned mechanism. In this weaving machine, a machine frame 101 supports vertically movably thereon a fixing frame 103 of a vertical yarn supporting plate 102 adapted to suspend a multiplicity of vertical yarns Z. The fixing frame 103 is vertically driven by the rotation of threaded shafts 105 synchronously rotated by a motor 104 or by some other suitable means. The vertical yarn supporting plate 102 is provided with vertical yarn fixing holes arrayed longitudinally and laterally in conformity with the density of yarn arrangement in the three-dimensional woven fabric to be formed or the cross-sectional shape of the woven fabric. Through the vertical yarn fixing holes, vertical yarns Z having a weight 106 attached to the lower end thereof are hung down.

In a weaving device 109 fixed to the machine frame 101 in the middle position thereof, as many carriers 111 as required for the weaving machine are fixed as arrayed regularly on the carrier fixing plate 110 constructed as illustrated in FIGS. 7–8 and FIGS. 12–13. These carriers 111 are synchronously moved by a suitable drive device and the bobbins holding thereon longitudinal yarns and lateral yarns or the yarns themselves are consequently displaced and zigzagged at the prescribed carrier pitch between the rows of vertical yarns Z to lay the lateral yarns and the longitudinal yarns between the rows of vertical yarns.

The package stations 107, 108 supply lateral yarns and longitudinal yarns in required length and keep the bobbins or longitudinal yarns and lateral yarns stored thereon for durations depending on the arrangement of yarns.

The bobbins or the yarns are mounted so as to be moved along the carrier fixing plate 110 to suit the arrangement of yarns, the width of woven fabric, etc. by a suitable drive device and a sequence control device, for example. Coiled yarns 112, 113 are chosen for lateral yarns and longitudinal yarns. The individual yarns are supplied in required lengths through the medium of the package stations 107, 108.

A frame 114 disposed on the machine frame 101 serves to determine the visible size and shape of the three-dimensional woven fabric being formed. It is desired to be capable of suitably adjusting the size and shape of its opening.

In the foregoing description of the invention, the three-dimensional woven fabric has been assumed as formed of yarns. The present invention can be worked advantageously with not merely what are generally called yarns but also fibrous aggregates formed of organic fibers, inorganic fibers, or metallic fibers, including filaments, robings, and tapes having noncontinuous fibers gathered in bundles.

What is claimed is:

1. A method for the formation of a three-dimensional woven fabric, said method comprising the steps of:

(a) causing arms of carriers disposed around one component yarn out of three mutually perpendicular component yarns to be rotated in the state of separately holding in place in said carrier arms of said carriers the shafts of each of bobbins on which the other two component yarns are wound in prescribed lengths;

(b) effecting transfer of said bobbins between opposing carrier arms of adjacent carrier; and (c) successively effecting transfer of bobbins to carrier arms of the subsequent carriers, thereby allowing said two component yarns to be displaced and zigzagged at least partially relative to the remaining one component yarn.

2. A method according to claim 1, wherein said transfer of yarns is effected by causing said carrier arms of said adjacent arms to be rotated in mutually opposite directions.

3. A method according to claim 1, wherein said transfer of yarns is effected by causing said carrier arms of said adjacent arms to be rotated in freely selected directions.

4. A method for the formation of a three-dimensional woven fabric, said method comprising the steps of:

(a) causing arms of carriers disposed around one component yarn out of three mutually perpendicular component yarns to be rotated in the state of separately holding the yarn ends of the other two component yarns in said carrier arms of said carriers;

(b) effecting transfer of said yarn ends between opposing carrier arms of adjacent carrier; and (c) successively effecting transfer of yarns to carrier arms of the subsequent carriers, thereby allowing said two component yarns to be displaced and zigzagged at least partially relative to the remaining one component yarn.

5. An apparatus for the formation of a three-dimensional woven fabric, said apparatus comprising:

(a) a multiplicity of carriers arrayed longitudinally and laterally on a carrier fixing plate, said carriers being each provided with a carrier shaft which incorporates therein an insertion hole and is provided with means for rotating said carrier;

(b) a carrier arm formed of a pair of arm pieces and disposed on said carrier shaft and possessed of at least one arm piece adapted to be opened and closed to effect transfer of yarns between adjacent carriers; and (c) means for rotationally driving said arm piece of said carrier arm, said means comprising a cam disposed coaxially on said carrier shaft, a toothed wheel for rotationally driving said cam, a lever operatively connected to said cam so as to oscillate in contact with said cam, a toothed wheel, and a rack for transforming the oscillation of said lever into a rotational movement and causing rotation of at least one of said arm pieces.

6. An apparatus according to claim 5, wherein said carrier arm is formed of a pair of arm pieces and said mechanism for rotationally driving said arm pieces is formed of a cam disposed coaxially on said carrier shaft, a toothed wheel for rotationally driving said cam, a lever adapted to oscillate in contact with said cam, a switch adapted to be actuated by said oscillation of said lever, an electromagnet adapted to be electromagnetically driven by the operation of said switch, and a toothed wheel and a rack for transforming the linear movement due to the driving of said electromagnet into a rotational movement and transferring said rotational movement to at least one of said arm pieces.

7. An apparatus according to claim 5, wherein said two component yarns to be displaced and zigzagged between rows of said one component yarns are wound on bobbins and the shafts of said bobbins are held in place between said arm pieces of said carriers.

8. An apparatus according to claim 5, wherein said arm pieces of said carrier arms are fitted with elastic pads to preclude accidental separation of yarns from between sair arm pieces.

9. An apparatus according to claim 5, wherein said carrier arm is formed of one arm piece, said arm piece is provided in the interior thereof with an air suction path opening near the leading end of said arm piece, said arm piece is provided with a yarn holding recess adapted to take hold of a yarn end and further provided with a tubular sheath adapted to slide forward when said recess takes hold of said yarn end.

10. An apparatus according to claim 5, wherein said carrier arm is formed of one pair of arm pieces and one of said arm pieces is fixed on said carrier shaft and the other arm piece is attached so as to be moved forward or backward relative to the remaining arm piece by hydraulic pressure.

* * * * *